United States Patent [19]

Simmons

[11] 4,394,783

[45] Jul. 26, 1983

[54] BODY CUSHION

[76] Inventor: Elizabeth J. Simmons, 18 Norton Rd., Broad Brook, Conn. 06016

[21] Appl. No.: 211,702

[22] Filed: Dec. 1, 1980

[51] Int. Cl.[3] ..... A47G 9/00

[52] U.S. Cl. ..... 5/432; 5/436; 5/437; 441/127

[58] Field of Search ..... 5/432, 465, 481, 436, 5/437, 442, 431; 297/4, 393, 230, 231, 456, 219; 128/78; 2/44; 441/125, 126, 127, 66

[56] References Cited

U.S. PATENT DOCUMENTS

| | | | |
|---|---|---|---|
| 716,752 | 12/1902 | Phillips | 5/465 |
| 2,589,013 | 3/1952 | Martin | 5/437 |
| 2,973,030 | 2/1961 | Matthewson | 128/78 |
| 3,093,407 | 6/1963 | Wilson | 5/481 |
| 3,737,923 | 6/1973 | Prolo | 128/78 |
| 4,097,086 | 6/1978 | Hudson | 297/397 |

FOREIGN PATENT DOCUMENTS

| | | | |
|---|---|---|---|
| 199301 | 7/1907 | Fed. Rep. of Germany | 297/4 |
| 1101008 | 9/1955 | France | 297/231 |
| 424500 | 5/1967 | Switzerland | 297/231 |
| 1049458 | 11/1966 | United Kingdom | 5/465 |

*Primary Examiner*—Alexander Grosz
*Attorney, Agent, or Firm*—George G. Butenkoff

[57] ABSTRACT

A body cushion for use in minimizing discomfort and fatigue is disclosed. The body cushion includes a top cushion, a bottom cushion, a base cushion disposed therebetween and flexible connectors connecting the top and bottom cushions to the base cushion. The flexible connectors enable the length of the body cushion to be adjustable to provide support from the occipital to ilium regions of the body. Means for attaching the body cushion to the back of a user or to a chair are provided.

13 Claims, 7 Drawing Figures

BODY CUSHION

DESCRIPTION

Technical Field

This invention relates to a body cushion and more particularly to a portable cushion constructed to provide comfort and support for sitting comfortably in an otherwise uncomfortable chair and the like.

Background Art

The use of seat cushions to provide comfort to the back and relieve fatigue are well known in the art. Matthewson in U.S. Pat. No. 2,973,030 discloses a body fatigue-relieving support device comprising a rigid post having a neck rest rigidly attached at one end, shoulder hangers fixedly attached to the rigid post proximate the neck rest and a strap holder at the other end for attaching the device to the body. The device is intended to provide adequate support of a person's body to minimize fatigue. Hall in U.S. Pat. No. 2,255,464 discloses a support for the backbone or spinal column of the human body. The support is adapted for attachment to the back of a person, or to a seat or placed upon a cot or bed in supporting position for the backbone of the user. The support includes a strut of semi-resilient and shock absorbent material sized to bear against the backbone or spinal column of a person, means for attaching the strut to the back of a person and a ridge structure of resilient material disposed on the strut for bearing against the backbone of the person. The device of Matthewson, being rigid does not provide comfort to the wearer and the device of Hall while being somewhat more comfortable does not provide support for the neck or the lower back portion of the body.

It is the general purpose of this invention to provide a simple, inexpensive and comfortable body support cushion for providing support and comfort to a person's back.

Disclosure of the Invention

A preferred embodiment of the present invention comprises a body cushion with a base cushion having a generally trapezoidal shape with a top, a bottom substantially parallel to the top, a front, a back and nonparallel sides, a top cushion, a first flexible connector having one end fixedly connected to the top of the base cushion and the other end attached to the top cushion, a bottom cushion, a second flexible connector having one end fixedly connected to the bottom of the base cushion and the other end attached to the bottom cushion.

A primary feature of the present invention is the body straps for attaching the body cushion to the back of a person. A further feature of the present invention is the flexible connectors attaching the bottom and top cushions to the base cushion. Additionally body straps attached to the base cushion allow the body cushion to be readily and conveniently transported on the user. This is particularly desirable in transporting patients with back disorders. Also a chair strap disposed on the back of the body cushion enables the body cushion to be affixed to a chair to provide back support to a person sitting therein.

A primary advantage of the present invention is the support provided the area of the body extending approximately from the occipital bone to the ilium. Additionally the flexible connectors allow the total length of the body cushion to be adjusted to provide optimum support.

The foregoing and other objects, features and advantages of the present invention will become more apparent in the light of the following detailed description of preferred embodiments thereof as shown in the accompanying drawing.

Best Mode For Carrying Out the Invention

Figure 1:
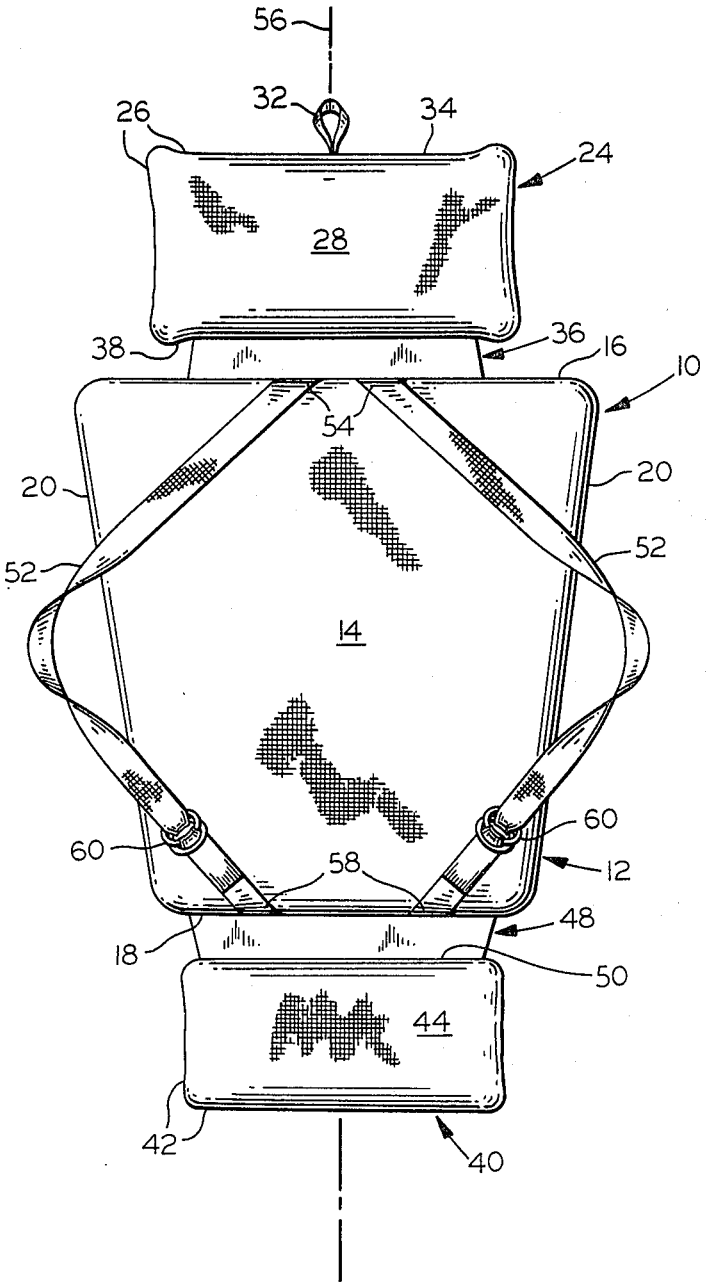
FIG. 1 is a front view of a preferred embodiment of a body cushion in accordance with the present invention.

Referring now to the drawing and more particularly to FIG. 1 which shows a front view of a body cushion 10 in accordance with the present invention. The body cushion includes a base cushion 12 having a front section 14 with a generally trapezoidal shape, a top 16, a bottom 18, substantially nonparallel sides 20 and a back section 22 with a generally trapezoidal shape as more fully shown in FIG. 3, a top cushion 24 having substantially rectangularly connected sides 26, a front surface 28, a back surface 30 as more fully shown in FIG. 3 and a hanging loop 32 attached to a top 34 of the top cushion 24, a first connector 36 fixedly attached at one end to a bottom 38 of the top cushion and fixedly attached at the other end to the top 16 of the base cushion 12, a bottom cushion 40 having substantially rectangularly connected sides 42, a front surface 44 and a back surface 46 as more fully shown in FIG. 3, a second connector 48 fixedly attached at one end to a top edge 50 of the bottom cushion and fixedly attached at the other end to the bottom 18 of the base cushion 12. The body cushion additionally includes a pair of body straps 52 disposed across the front section 14 and adapted for attachment around the shoulders of a person wherein the body straps each have a first end 54 fixedly attached, symmetrically about a centerline axis 56, in a spaced apart relationship to one another, to the top 16 of the base cushion and a second end 58 fixedly attached, symmetrically about the centerline axis 56 in a spaced apart relationship to one another, to the bottom 18 of the base cushion. Each body strap includes an adjustment buckle 60 such as D-rings for adjusting the length of each body strap.

Figure 2:
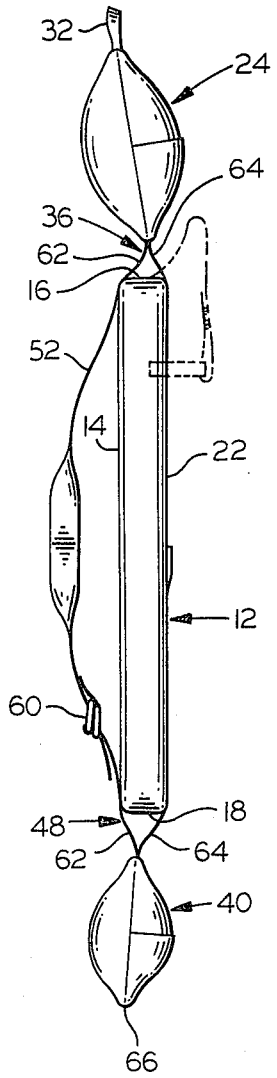
FIG. 2 is a side view of the invention shown in FIG. 1.

Referring now to FIG. 2, which is a side view of the body cushion shown in FIG. 1, there is seen the preferred shape of the body cushion. The base cushion 12 has a substantially rectangular cross section while both the top and bottom cushions 24, 40, respectively have substantially elliptical cross sections as shown in FIG. 2. The first and second connectors 36, 48, respectively in the preferred embodiment are made of a soft flexible material such as cloth or the like and are fabricated with a front part 62 and a back part 64 with the front and back parts each having one end essentially attached together and also attached to the top and bottom cushions each having a second end and attached in a spaced apart relationship to the base cushion 12 one of with the front parts 62 attached substantially at the juncture of the top 16 and the front section 14 of the base cushion and the other front part attached substantially at the juncture of the bottom 18 and the front part 14 of the base cushion 12 and with the other end of the back parts 64 attached substantially at the juncture of the top 16 and the back section 22 of the base cushion and the other back part attached substantially at the juncture of the bottom 18 and the back section 22 of the base cushion 12 respectively.

The first and second flexible connectors 36, 48, respectively are flexible such that when the top 34 of the top cushion 24 is at the occipital bone area of the head of a person using the body cushion, the bottom 38 of the top cushion 24 and the top 16 of the base cushion 12 are approximately at the seventh cervical vertebra and the bottom 18 of the base cushion 12 is approximately positioned at the tenth rib of the user and the bottom 66 of the bottom cushion 40 is approximately positioned at the illium of the user. The flexible connectors allow the distance between the base cushion and the head cushion and the bottom cushion respectively to adjust to the length of a user's body.

The body straps 52 are adapted for attachment over the shoulders of the user and are adjustable with the buckles 60 for fitting various body sizes. The body straps enable the body cushion to be readily transportable from chair to chair and the like and for adjusting the position of the body cushion on the back of the user. Additionally when used by a disabled person the body straps allow the body cushion to be attached to or by such disabled person to minimize back strain on said person. The strap allows a disabled person to put the body cushion on and leave it on thereby minimizing readjustment maneuvers and thus minimizing back strain.

Figure 3:
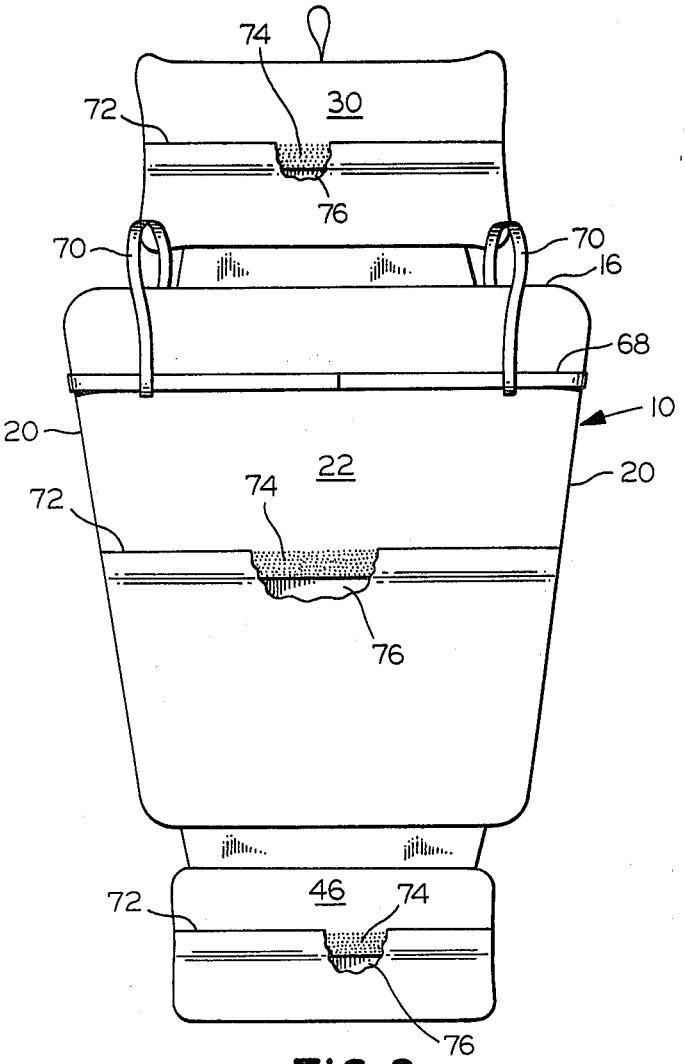
FIG. 3 is a back view of the invention shown in FIG. 1.

Referring now to FIG. 3 which shows a back view of the body cushion. The body cushion further includes a chair strap 68 disposed across the back section 22 having one end attached proximate the juncture of the back section 22 with one of the nonparallel sides 20 and another end attached proximate the juncture of the back section 22 and an opposite nonparallel side. The chair strap 68 is positioned on the upper half of the base cushion proximate the top 16. A pair of adjustable vertical straps 70 are each fixedly attached in a spaced apart relationship to one another at the top 16 of the base cushion and are adjustably secure to the chair strap 68. In a preferred embodiment the ends of the vertical straps 70 loop around the chair strap and are removably attached to the remainder of the vertical straps by means well known in the art such as hook and loop fasteners. It is to be recognized that numerous methods well known in the art exist for adjustably securing the vertical straps to the chair strap. The chair strap is adapted for being placed around the upper portion of a chair or the like to secure the body cushion thereto. The vertical straps are adjustable for adjusting the vertical position of the body cushion on the chair.

Figure 4:
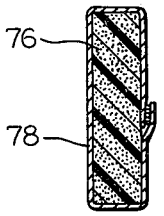
FIG. 4 is a cross-sectional side view of the base cushion shown in FIG. 1.

The back section 22, of the base cushion 12, back surface 30 of the top cushion 24 and the back surface 46 of the bottom cushion 40 all have a slit 72 disposed therein running across the width of the respective sections of the body cushion from side to side. In the preferred embodiment the slits are fitted with hook and loop fasteners 74 such as Velcro ® or the like for releasably closing the slit. The slit is adapted for removing the inner material 76 as shown in FIG. 4 from the cover material 78. The cover material is typically of a soft material such as cloth or the like. The inner material is made of soft material such as sponge rubber or the like and is completely encapsulated by the cover material.

It is to be recognized that the top cushion, the bottom cushion and the base will typically all have the same construction. It is also to be recognized that the cover material may form an airtight enclosure and the inner material may be substituted with pressurized air or other gas. Appropriate gas insertion means, such as valve stems 96 as shown in FIG. 7 which are well known in the art, would be disposed in the top, bottom and base cushions for getting the gas in and out of the body cushion.

Figure 5:
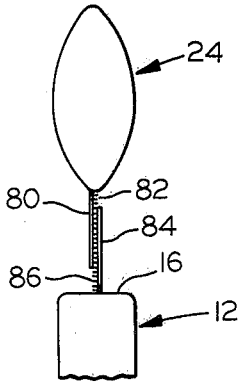
FIG. 5 is a side view showing an adjustable flexible connector between the top cushion and the base cushion of the body cushion.
Figure 6:
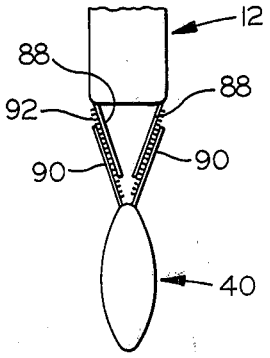
FIG. 6 is a side viw of an embodiment of a flexible connector shown in FIG. 1.
Figure 7:
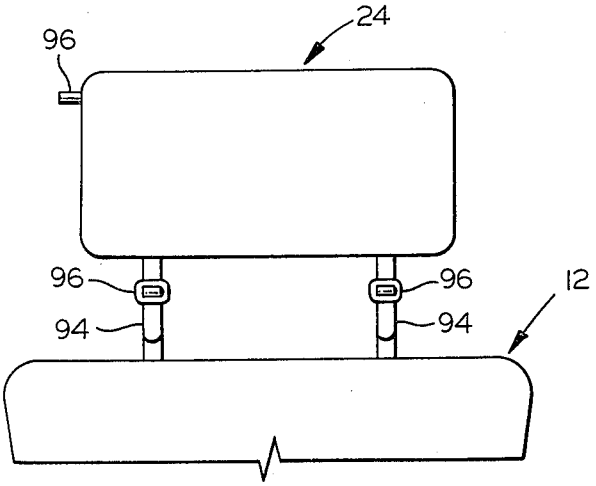
FIG. 7 is a front view of a further embodiment of the adjustable connector shown in FIG. 1.

Referring now to FIGS. 5, 6 and 7 which show alternate flexible connectors. In FIG. 5 the flexible connectors comprises a first length 80 of material fixedly connected at one end to the bottom 38 of the top cushion 24 and containing a "hook" material 82 attached thereto. A second length of material 84 is attached at one end to the top 16 of the base cushion 12 and includes a loop material 86 wherein the hook and loop material are adapted for attachment to one another to form a hook and loop fastener. The distance between the top cushion and the base cushion is readily adjusted using the hook and loop fastener to provide connectors having a variable length. FIG. 6 shows an alternate view of an adjustable connector employing a pair of first extenders 88 disposed in a spaced apart relationship to one another on the bottom 18 of the base cushion 12 with hook-type material disposed thereon and a pair of second extenders 90 with loop-type material disposed thereon attached at one end to the top 50 of the bottom cushion 40 with the other end adapted for joining with the first extenders with the hook and loop material forming a fastener 92 disposed therebetween to form a flexible connector. FIG. 7 shows a further alternate connection employing a pair of connection straps 94 connecting the top cushin 24 to the base cushion 12. The connection straps include adjustment means well known in the art such as the buckles 96. It is to be recognized that the various flexible connectors disclosed herein may be utilized to connect either, or both, the top and bottom cushions to the base cushion.

It is also to be recognized that the hook and loop fastener may be replaced with any of the well known pressure sensitive fasteners.

It can therefore be seen that in accordance with the present invention, there is provided a body cushion which provides support to a user's back from the top of the occipital bone in the head to the ilium region of the back to provide support and relief.

Although the invention has been shown and described with respect to a preferred embodiment thereof, it should be understood by those skilled in the art that other various changes and omissions in the form and detail thereof may be made therein without departing from the spirit and the scope of the invention.

I claim:

1. A body cushion comprising:

a base cushion having a generally trapezoidal shape with a top, a bottom substantially parallel to the top, a front section, a back section and nonparallel sides;

a top cushion;

a bottom cushion;

a first connector made of soft flexible material and having one end fixedly connected to the top of the base cushion and the other end attached to the top cushion;

a second connector made of soft flexible material and having one end fixedly connected to the bottom of the base cushion and the other end attached to the bottom cushion;

means for adjusting the length of the first and second connector for varying the separation between the top cushion and the base cushion and between the bottom cushion and the base cushion; and a pair of body straps each having a first end fixedly attached, in a spaced apart relationship to one another, to the top of the base cushion and each having a second end fixedly attached, in a spaced apart relationship to one another, to the bottom of the base cushion wherein the body straps are adapted for attachment around the shoulders of a person for securing the body cushion to the back of said person.

2. The invention in accordance with claim 1 further including means for adjusting the length of each body strap to accommodate various body sizes of various users.

3. The invention in accordance with claim 1 further including a chair strap disposed across the back section of the base cushion having one end attached proximate a juncture of the back section with one of the nonparallel sides and another end attached proximate a juncture of the back section and an opposite nonparallel side, and a pair of adjustable verticle straps each having a first end fixedly attached to the top of the base cushion, in a spaced apart relationship to one another, and each having a second end adjustably secure to the chair strap wherein the chair strap and the vertical straps are adapted for securing the body cushion to a chair or the like.

4. The invention in accordance with claim 1 wherein the first and second connectors each have a front part and a back part wherein the front and back parts each have one end essentially attached together and also attached to the top and bottom cushions and each has a second end attached, in a spaced apart relationship to one another, to the top and bottom respectively of the base cushion wherein the structure of the connectors is the means for adjusting the length of the body cushion such that when the top of the top cushion is approximately at the occipital bone area of a user, the bottom of the base cushion is approximately at the tenth rib of the user and a bottom of the bottom cushion is approximately positioned at the ilium of said user.

5. The invention in accordance with claim 4 wherein the connectors are further adapted for adjusting the length of the body cushion such that a bottom of the top cushion is approximately at the seventh cervical vertebra when the bottom of the base cushion is approximately at the tenth rib of the user.

6. The invention in accordance with claim 1 further including a hanging loop attached to a top of the top cushion.

7. The invention in accordance with claim 1 wherein the top, base and bottom cushions are fabricated with an inner material of soft material encapsulated by a cover material.

8. The invention in accordance with claim 7 further including means for removing the inner material from the cover material.

9. The invention in accordance with claim 8 werein the means for removing the inner material from the cover material is a slit disposed along the width of the top, base and bottom cushions.

10. The invention in accordance with claim 9 further including means for releasably closing the slits.

11. The invention in accordance with claim 1 wherein the top, base and bottom cushions are fabricated of a cover material capable of forming an airtight enclosure and include means for pressurizing the enclosure with gas.

12. The invention in accordance with claim 1 wherein the means for adjusting the separation between the top cushion and the base cushion includes a first length of material fixedly attached at one end to the top cushion with hook material attached thereto and a second length of material attached to the base cushion with loop material attached thereto wherein the first and second material are releasably joined together with the hook and loop material to form a connector having a variable length and the means for adjusting the separation between the bottom cushion and the base cushion includes first length of material fixedly attached at one end to the bottom cushion with hook material attached thereto and a second length of material attached to the base cushion with loop material attached thereto wherein the first and second material are releasably joined together with the hook and loop material to form a connector having a variable length.

13. The invention in accordance with claim 1 wherein the means for adjusting the separation between the top cushion and the base cushion includes a pair of first extenders fixedly attached at one end to the base cushion, in a spaced apart relationship to one another, and a pair of second extenders fixedly attached at one end to one another and to the top cushion wherein the first and second extenders are removably attached proximate their second ends with a pressure sensitive material and the means for adjusting the separation between the bottom cushion and the base cushion includes a pair of first extenders fixedly attached at one end to the base cushion, in a spaced apart relationship to one another, and a pair of second extenders fixedly attached at one end to one another and to the bottom wherein the first and second extenders are removably attached proximate their second ends with a pressure sensitive material.

* * * * *